US010375491B2

(12) United States Patent
Larssen et al.

(10) Patent No.: US 10,375,491 B2
(45) Date of Patent: Aug. 6, 2019

(54) HEARING DEVICE WITH A BARRIER ELEMENT

(71) Applicant: Oticon A/S, Smørum (DK)

(72) Inventors: Michael Frydendal Larssen, Veksø Sj. (DK); Michael Frank Petersen, Smørum (DK); Troels Holm Pedersen, Smørum (DK); Brian Spidsbjerg, Ballerup (DK); Lars Monroy, Kongens Lyngby (DK); Lars Persson, Smørum (DK); Jesper Pedersen, Smørum (DK); Sune Heibing, Smørum (DK); Mikael Andersen, Smørum (DK); Henning Bjerregaard, Smørum (DK); Niels Erik Holm Christensen, Virum (DK); Preben Kvist, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 16/045,419

(22) Filed: Jul. 25, 2018

(65) Prior Publication Data

US 2018/0332413 A1 Nov. 15, 2018

Related U.S. Application Data

(62) Division of application No. 15/333,762, filed on Oct. 25, 2016, now Pat. No. 10,057,697.

(30) Foreign Application Priority Data

Oct. 26, 2015 (EP) ..... 15191382

(51) Int. Cl.
*H04R 9/08* (2006.01)
*H04R 25/00* (2006.01)

(52) U.S. Cl.
CPC ..... *H04R 25/654* (2013.01); *H04R 25/60* (2013.01); *H04R 25/658* (2013.01)

(58) Field of Classification Search
CPC ..... H04R 1/02; H04R 25/456; H04R 25/604; H04R 1/1016; H04R 2225/021
See application file for complete search history.

(56) References Cited

U.S. PATENT DOCUMENTS 6,122,389 A 9/2000 Grosz
8,295,527 B2 10/2012 Chen
8,515,113 B2 * 8/2013 Rothkopf ..... H04R 31/00 381/355

(Continued)

FOREIGN PATENT DOCUMENTS

EP 1 521 498 A2 4/2005
WO WO 96/25019 A1 8/1996

(Continued)

*Primary Examiner* — Amir H Etesam
(74) *Attorney, Agent, or Firm* — Birch, Stewart, Kolasch & Birch, LLP

(57) ABSTRACT

A hearing device, e.g. a hearing aid, having a protection system is disclosed. The device includes an input unit for receiving an acoustic signal from a user's surroundings and providing a corresponding audio signal, and an output unit receiving said audio signal and providing an audible signal to the user, where the hearing device further includes a barrier element for protecting elements of the hearing device. Furthermore, the disclosure relates to a hearing device inlet system.

21 Claims, 6 Drawing Sheets

(56) References Cited

U.S. PATENT DOCUMENTS

| | | | | |
|---|---|---|---|---|
| 9,247,329 | B2 | 1/2016 | Sondergaard | |
| 2008/0019554 | A1* | 1/2008 | Krywko | H04R 1/1058 381/380 |
| 2008/0187161 | A1* | 8/2008 | Tiemens | B29C 44/1214 381/380 |
| 2010/0322452 | A1 | 12/2010 | Ladabaum et al. | |
| 2014/0205131 | A1* | 7/2014 | Azmi | H04R 1/1075 381/380 |

FOREIGN PATENT DOCUMENTS

| | | | |
|---|---|---|---|
| WO | WO 03/067926 | A2 | 8/2003 |
| WO | WO 2010/151492 | A1 | 12/2010 |

* cited by examiner

HEARING DEVICE WITH A BARRIER ELEMENT

CROSS REFERENCE TO RELATED APPLICATIONS

This application is a Divisional of copending application Ser. No. 15/333,762, filed on Oct. 25, 2016, which claims priority under 35 U.S.C. § 119(a) to application Ser. No. 15/191,382.9, filed in Europe on Oct. 26, 2015, all of which are hereby expressly incorporated by reference into the present application.

FIELD

The present disclosure relates to preventing various internal or external environmental substances from interfering with the sound quality of a hearing device, such as that of a behind-the-ear (BTE), in-the ear (ITE), in-the-canal (ITC) or a receiver-in-the-ear (RITE) type hearing device, such as a hearing aid. Furthermore, the present disclosure relates to a hearing device inlet system providing a mechanical and acoustical interface between and exterior and interior environment of the hearing device.

BACKGROUND

The human ear is composed of the outer ear, including the pinna, the middle ear and the inner ear. The function of the pinna is to guide sound into the ear canal of the outer ear, which further guides the sound from the ear canal of the outer ear via the middle ear to the inner ear. Different kind of hearing devices for compensating for a hearing loss exist and the hearing devices are adapted to be worn in any known way. This may include i) arranging a unit of the hearing device behind the ear with a tube leading air-borne acoustic signals into the ear canal or with a receiver/loudspeaker/speaker arranged close to or in the ear canal such as in a Behind-the-Ear type hearing aid, and/or ii) arranging the hearing device entirely or partly in the pinna and/or in the ear canal of the user, such as in an In-the-Ear type hearing aid or In-the-Canal/Completely-in-Canal type hearing aid.

In general, any type of hearing device is exposed to various internal or external environmental substances that might influence the sound quality of the hearing device, if coming into contact with sound sensitive components of the hearing device. Especially, the internal and external surfaces of the hearing device and the components thereof may be exposed to dirt, moisture, earwax and other damaging substances that might cause an obstruction in the sound path of the hearing device. Thus, hearing devices should survive a harsh environment during daily use.

Generally, the outer ear of the human ear has an oval cross section. When inserting a hearing device into the ear canal it will often be exposed to cerumen, also known as earwax, which build up within the ear canal of the outer ear. The oily substances of earwax tend to migrate on the external and/or internal surfaces of the hearing device, and might potentially penetrate further into the components of the hearing device. On the interior surfaces, the earwax could cause damage to the sound sensitive elements, such as the microphones, receiver, speaker or other internal components, if the sensitive parts inside these internal components is contaminated. Therefore, a reliable protection system is critical for the reliability of the hearing device. Earwax ingress is one of the most common reasons for non-working hearing devices send back to the manufacture for service/repair.

On the external sides of the hearing instrument, such as the behind-the-ear part, the surfaces may further be exposed to dirt, sweat or other potentially damaging substances, which might also migrate into the inner structures of the hearing aid. Thus, it is desirable to protect the sound sensitive parts of the internal components, such as the microphone(s) and/or receivers (i.e. speakers(s)) of the hearing device, against migration of damaging substances from the interior and/or exterior environment that may potentially obstruct the sound conduction path in the hearing device.

Conventionally available earwax, moisture and dirt protection systems use a woven/non-woven filter or substrate placed somewhere in the sound path—from the outside of the instrument to the microphone. These filters allow sound to pass while the obstructing substances is absorbed in the filter/substrate material. One problem with this kind of protection system is that the filters need replacement on regular basis, to prevent the filters from clogging and block the sound path in the hearing device (e.g. a hearing aid). Many hearing device users find it difficult to replace such filters and might not follow the prescribed replacement intervals and ends up with a non-working hearing device.

Therefore, there is a need to provide a solution that addresses at least some of the above-mentioned.

SUMMARY

Accordingly a hearing device, for example a hearing aid is disclosed. The hearing device comprises an input unit for receiving an acoustic signal from a user's surroundings and providing a corresponding audio signal, and an output unit receiving the audio signal and providing an audible signal to the user, where the input and/or output units comprise a sound port which are exposed to the exterior and/or an interior environment of the hearing device, the hearing device further comprising a barrier element having a base part and a neck part, said neck part protruding from said base part, and said base part and neck part forming an inner channel of the barrier element, wherein the inner channel of the barrier element is arranged to substantially surround a circumferential edge of at least a part of the sound port while allowing for sound to pass through said inner channel to said inlet and/or outlet port, and wherein said neck part is substantially angled in relation to a longitudinal centerline of said inner channel.

The barrier element according to the disclosure provides an effective earwax, dirt and moisture-ingress protection system. The configuration of the barrier element with a base part and a neck part where the inner channel is substantially arranged around a circumferential edge of the sound port of the input and/or output unit, creates a substantially tight enclosure around the sound sensitive parts, such as a sound port of the input and/or output unit. That is, the barrier element protects the sound port from the surroundings by enclosing the structures thereof and as such seals off the structure from the surrounding environment. The "open profile" (i.e. the inner channel) of the barrier element makes it a long lasting protection system, where the internal components, such as microphone built-in dampening filter structures, where earwax, moist, dirt or other damaging substances could be absorbed and clog the sound path, is protected.

According to an embodiment of the disclosure, the exterior environment is understood to include the environment, which the outer sides, such as for example a shell of the hearing device, are exposed to. For example in a BTE component, where a part of the hearing aid is arranged behind the ear, the exterior environment is construed to include the skin and the environment in general surrounding the skin, such as hair, air, and other external substances that might come into contact with the surface area of the hearing aid.

Concerning the interior environment, this is construed to include the environment inside the hearing aid. Thus, any parts within for example an outer shell facing the exterior environment, is part of the interior environment. Substances from the exterior environment may thus when entering through outer parts of the hearing aid form part of the interior environment of the hearing aid.

According to an embodiment of the disclosure, the sound port and the neck part may be arranged in relation to each other, such that the neck part protrudes from the base part in the same direction as the sound port. In other words, the sound port protrudes from a surface of the input and/or output unit in the direction of receiving and/or outputting sound. Accordingly, the neck part protrudes in the same direction parallel with the sound port.

In more detail, the angled neck part of the barrier element efficiently has the effect of guiding approaching substances away from the opening in the barrier element. The opening of the barrier element is defined by an entry opening in a top of the barrier element and an exit opening in a bottom part of the barrier element, which forms the inner entry and exit of the inner channel. Thus, when moisture, dirt, earwax or other substances comes into contact with the surfaces of the barrier element, the substances is led along the angled outer sides of the neck part of the barrier element and are thus led away from the sound sensitive parts of the sound inlet and/or outlet ports. The angled construction simply guides the substances towards the base part of the barrier element instead of into the inner channel, which substantially constitutes at least a part of the sound port. Thus, the damaging substances is restricted from reaching the sound port, and the sound path is kept intact by the barrier element such that sound may freely pass to/from the sound port of the inlet and/or output unit.

Thus, the neck part is shaped such that at least the outer sides of the neck part, i.e. the sides facing the interior environment, define an angle with the centerline of the inner channel. The angle should be construed to be the smaller angle, a, which the centerline and an imaginary line drawn from the outer side of the neck part forms with the centerline.

Within an embodiment of the disclosure, it should be construed that the inner sides of the neck part (i.e. the sides of the neck part substantially constituting the sides of the inner channel) could also be angled in relation to a centerline of the inner channel. As previously mentioned the angle may also here be construed as the smaller angle, $\beta$, formed by drawing a line along the inner side of the neck part to the longitudinal centerline.

Accordingly, in an embodiment of the disclosure, the neck part may define two angles, a first angle, $\alpha$, and a second angle, $\beta$, with the centerline c of the longitudinal channel. In an embodiment of the disclosure the angle is such that $\alpha \geq \beta$, with respect to the longitudinal centerline of the inner channel. In an embodiment, the angle $\beta=0$ in relation to the centerline (i.e. axis of revolution).

In more detail according to an embodiment of the disclosure, the sound port of the input and/or output unit extends into the inner channel of the barrier element, such that at least the base part of the barrier element surrounds the circumferential edge of the sound port with or without sheltering the sound port. In effect, the sound outlet port are efficiently protected against incoming substances. The sheltering of the barrier element provides a protection barrier of the sound port. Concerning the sheltering effect of the barrier element, it should be understood that at least a part of the barrier element cover at least the circumferential edge of the sound port to the extent that it is enclosing the sound port.

In an embodiment of the disclosure, the sound port may be sheltered by the base part alone, in which case the sound part does not extend into the neck part. Furthermore, the sound port could extend into the base part and further into neck part. In any case, the barrier element provides sheltering, i.e. protection from the environment, by surrounding the sound port to the extent that environmental substance does not come into contact with the circumferential edges and/or an top region of the sound port.

The efficient protection system provides a path for guiding the damaging substances away from the sound port. According to an embodiment of the disclosure, the barrier element comprises a neck part, which defines an angle with the longitudinal centerline of less than 90 degrees. The longitudinal centerline of the inner channel should be understood to be an imaginary line extending in the longitudinal direction of the inner channel, such that points along the centerline has an equal distance to the inner sides of the inner channel. It should be noted that the angle between the longitudinal centerline is larger than zero degree, but less than 90 degree. In embodiments according to the disclosure, the angle could be within the range of 0 to 90 degrees, 30 to 80 degrees or 45 to 65 degrees.

Accordingly, the inner channel is in an embodiment of the disclosure substantially uniformly shaped along the longitudinal direction thereof. That is, no decrease or increase in the width of the inner channel is present in the longitudinal direction thereof.

In an embodiment of the disclosure, the longitudinal centerline of the inner channel could also have varying distances to the inner sides of the channel, such that the distance from the inner sides of the channel to points along the centerline is varying. For creating an angle, $\beta$, with the centerline, the distance is decreasing as a function of distance from the base part of the barrier element to the opening of the neck part.

However, in an embodiment according to the disclosure s it is apparent that the inner channel does not need to be uniform. For the sake of definition, it should be understood that, the inner channel could be circular, rectangular, cone shaped or other suitable geometrical shapes, which would fit with a similar shaped circumferential edge of a sound port of the input and/or output unit. Thus, the width of the channel should be understood to be taken from a point on one inner side of the inner channel to a point of an opposite inner side of the inner channel crossing the longitudinal centerline.

According to an embodiment of the disclosure, the neck and base part is substantially circular and the base part forms a ring around at least a part of the sound port of at least one of said input and/or output units. The provision of the base part forming a ring around the sound port creates an abutment to the surface area of the remaining inlet and/or outlet unit. Thus, the surface area, from where the sound port extends from the inlet and/or outlet unit, is covered by the barrier element. This provides for an easy assembly of the components together with a sealing of the surface area. Furthermore, it should be apparent for a person skilled in the art, that this "ring shape" could also be rectangular or any other suitable geometrical shape, which would efficiently cover the necessary parts of the surface area of the input and/or output unit. The base part of the barrier element has a shape that covers at last a part of the surface area around the sound port of the inlet and/or outlet unit to create a sealing effect.

Furthermore, in an embodiment of the disclosure, the neck part at the transition point between the base part and the neck part comprises a first thickness, and at the opening comprises a second thickness, which thickness decreases in size as a function of distance from the transition point to the opening of said neck part, or at least that said second thickness is smaller than said first thickness.

Preferably, the opening of the neck part comprises a substantially rounded shape having a thickness of less than 0.1 mm. In an embodiment, the thickness is of 0.075 mm or 0.13 mm. In embodiments according to the disclosure, the thickness is within the range 0 mm to 0.2 mm. The "opening of the neck part", should be understood as the part of the neck part, which is situated in a distance from the base part and essentially forms the opening of the inner channel.

The thickness should be understood to be defined by a point on the inner side wall of the inner channel to a point on the outer side of the surface of the neck part. With a small thickness of this opening of the neck part, the damaging substances is prevented to enter into the inner channel. For example, droplets of sweat, fluid earwax is of such molecular size that when coming into contact with the sharp edge (i.e. the thinned thickness of the opening part), the drops are hindered in migrating across the opening, but instead are forced down the outer side surface of the angled neck part of the barrier element. Thus, the small thickness of the upper opening part of the neck hinders damaging substance to enter the inner channel and essentially to encounter the sound port.

In yet an embodiment of the disclosure, the barrier element is retained at the inlet and/or outlet unit by fastening means of the sound port. The fastening means could for example be provided by protruding flanges provided at the sound port. Such protruding flanges may in an embodiment snap-lock with corresponding grooves of the barrier element. Thus, the barrier element and sound ports comprises complementary female and male parts that interact to create a retention mechanism.

Alternatively or additionally, the fastening elements may also be provided as part of a cover element having at least one sound opening which is in acoustic communication with the sound port of the input and/or output unit, and comprises a set of fastening element, the fastening elements being configured to retain the barrier element at the position of substantially surrounding a circumferential edge of at least a part of the sound port of one of the input and/or output unit.

In an embodiment of the disclosure, the cover element may be arranged substantially on top of the barrier element structure, such that the fastening elements of the barrier element contacts the surfaces of the barrier element and essentially provides a compressing force thereto, such as through a spring mechanism. Thus, the compression of the barrier element, not only creates a fixed positioning within the hearing device, but does also provides for an improved sealing.

Furthermore, the cover element, may be configured such that the sound inlet opening is positioned substantially aligned with the sound port of the hearing device, creating a direct sound path between the sound opening in the cover element and the sound port of the input and/or output unit. With a direct sound path, should be understood that the sound would be less prone to fluctuate in the surrounding structure, but instead be guided directly to the receiving source (i.e. the sound port), such as a microphone within a hearing device.

The cover element may in an embodiment according to the disclosure form part of a hearing device inlet system providing a mechanical and acoustical interface between and exterior and interior environment of the hearing device.

Such hearing device inlet system may comprise a top shell (i.e. the cover element) and a bottom shell (i.e. a chassis) which in an assembled condition forms part of the hearing device, and wherein at least an input unit (according to the present disclosure) is arranged on the bottom shell, where said top shell is configured to cover the input unit.

The top shell (i.e. the cover element) may in an embodiment be configured with features corresponding to the previously described cover element. That is, the cover element may be provided with fastening elements, such as flanges or ribs extending along an inner side of the cover element. This, to support a barrier element according to the present disclosure and as previously described. The barrier element, may have features corresponding to the embodiments described within this disclosure.

The cover element may further comprise at least one sound opening, which is substantially aligned with a sound port on the input unit providing a direct sound path between the sound opening and the sound port.

In an embodiment, the cover element may comprise at least two sound openings, such as two sound inlets, which in an assembled condition are aligned with a second sound port of a second input unit of the hearing device.

In an assembled condition of the hearing device inlet system, the flanges of the cover element substantially abuts sides of a barrier element (as previously described), such that an inlet cavity between the sound opening in the cover element and the barrier element is created. Such inlet cavity creates a volume in front of the inlet unit, which can be trimmed to match the input unit of a second inlet cavity provided in the hearing device. Such matching provides an improved acoustical behavior of the hearing device inlet system.

In addition, the inlet volumes may in this way be designed to minimize the impact from high frequency noise. In other words, the inlet cavities provides an acoustical volume which is critical for the final acoustical performance of the hearing device. In an embodiment, the volumes is designed, and matched such that the acoustical response from a first inlet unit (e.g. a microphone) and a second inlet unit (e.g. a second microphone) is identical.

In an embodiment the top shell (i.e. the cover element) may furthermore comprise a set of attachment elements, such as hooks, which in an assembled condition is configured to connect with the bottom shell (i.e. a chassis) so that the cover element is fixed to and kept in place on the chassis. Thus, the top shell and bottom shell are configured to create a detachable click-locking configuration, such that the cover element may be attached and detached as needed. Together, the top shell and bottom shell thereby defines a substantially closed environment having at least one barrier element, and input unit and possibly also a pad element.

Accordingly, the bottom shell (i.e. the chassis) may in an embodiment comprise a set of receiving parts which are configured to receive the attachment elements of the cover element.

In a further embodiment a pad element, such as a foam pad, may be arranged on the chassis. Such element, preferably made by foam, generates the required sealing force between the top shell and the bottom shell of the hearing device inlet system.

In addition, the pad element, may absorb and/or decouple the vibrations caused by for example the output unit (e.g. an receiver) before it reaches the input units. In a hearing device, the input units are often sensitive elements, such as microphones, which are influenced by incoming vibrations, for example vibrations provided by an output unit, such as a receiver in the hearing aid. By providing a pad element, for example a foam pad, according to an embodiment of the disclosure, such vibrations may be dampened and the required feedback margins can be obtained.

In an assembled condition of an embodiment according to the disclosure, the pad element is compressed to approximate 50% of the original thickness. Furthermore, in an embodiment according to the disclosure, the pad element comprises an adhesive back-liner providing an adhesive surface enabling the pad element to stick to the bottom shell and support the input units.

The hearing device inlet system according to the disclosure is configured such that the assembled parts may be programmed and tested prior to the final assembly with other parts of a hearing device providing a final hearing aid, such as with outer shells of the hearing aid. An outer shell should be understood to comprise any shell which are arranged on top of the cover element and/or chassis in ort der to cover the internal components of the hearing device. Thus, the outer shell is the outer-most shell which a hearing aid user handles during use.

Accordingly, the hearing device inlet system may, with the described configuration of the different parts be pre-assembled, at least for programming and testing by

- providing a cover element having the features according to the disclosure,
- providing a chassis having the features according to the disclosure,
- providing at least one inlet unit,
- providing a pad element, and
- attaching the pad element to the chassis, and
- attaching the input units to the pad element (e.g. through a printed circuitry board), and
- attaching the cover element to the chassis by connecting the attachment elements of the cover element and the chassis.

With this assembly, the hearing device may be programmed and tested without losing the inlets parts (e.g. the cover and input units) thereof. The hearing device inlet system, is with this configuration designed as a platform where the different acoustic tests may be performed prior to a final assembly of the hearing aid. Thus, the hearing device inlet system, is used as a pre-testing platform, which may be used in different kinds of hearing devices.

As will become apparent throughout the description, it should be noted that the input unit of the hearing device may be a microphone configured to receive an acoustic signal and that the output unit may be a receiver, such as a loudspeaker, configured to emit a processed acoustic signal to the eardrum of a hearing device user.

Further embodiments of the present disclosure of a hearing device will become apparent from the following detailed description of the drawings.

BRIEF DESCRIPTION OF DRAWINGS

The embodiments of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each embodiment may each be combined with any or all features of the other embodiments. These and other embodiment, features and/or technical effect will be apparent from and elucidated with reference to the illustrations described hereinafter in which:

DETAILED DESCRIPTION

Figure 1:
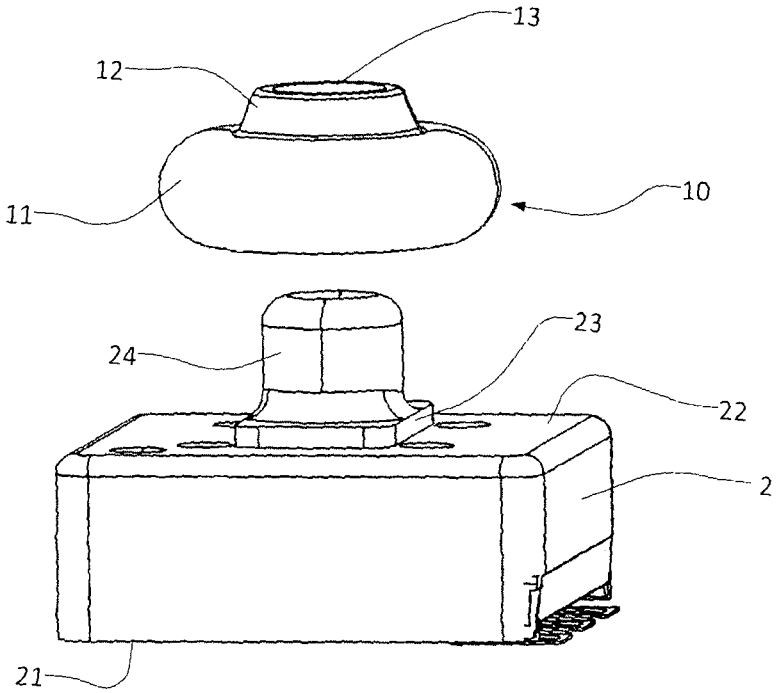
FIG. 1 illustrates an exploded perspective view of a microphone and a barrier element of a hearing device according to an embodiment of the disclosure.

The detailed description set forth below in connection with the appended drawings is intended as a description of various configurations. The detailed description includes specific details for providing a thorough understanding of various concepts. However, it will be apparent to those skilled in the art that these concepts may be practiced without these specific details. Several embodiments of the device are described by various functional units, modules, and components (also referred to as "elements"). Depending upon particular application, design constraints or other reasons, these elements may possibly be combined in any way within the various configurations.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneous or percutaneous to the skull bone or a vibrator for providing a structure-borne or liquid-borne acoustic signal.

Within the meaning of the present disclosure it should be understood that the barrier element could be applied to several of the input and/or output units as will become apparent in the following. It should be understood that the barrier element as described may be applied to any type of transducer. Thus, it is contemplated that the function and purpose of the barrier element as described may be applied to both microphones and loudspeakers of a hearing device, where use of such a barrier element are needed.

Now referring to FIG. 1, which illustrates an exploded side view of parts of a hearing device, such as a hearing aid. FIG. 1 illustrates only some internal parts of the hearing device, where the outer shell and other parts have been left out for the purpose of explaining the general disclosure. As already mentioned a hearing device comprises an input unit and/or an output unit. The common function of the input and output unit is to receive and transmit a sound signal, either an acoustic or electrical sound signal, and converting this signal into an audio and/or electrical signal. Thus, such input and/or output unit transforms the audio signal, and may also be called a transducer, a microphone, loudspeaker or receiver. For the sake of simplicity, the following drawings provides a detailed description of a use of the barrier element within a hearing aid. The use of the barrier element will be explained in relation to a microphone and speaker unit, however without being limited thereto.

Figure 3:
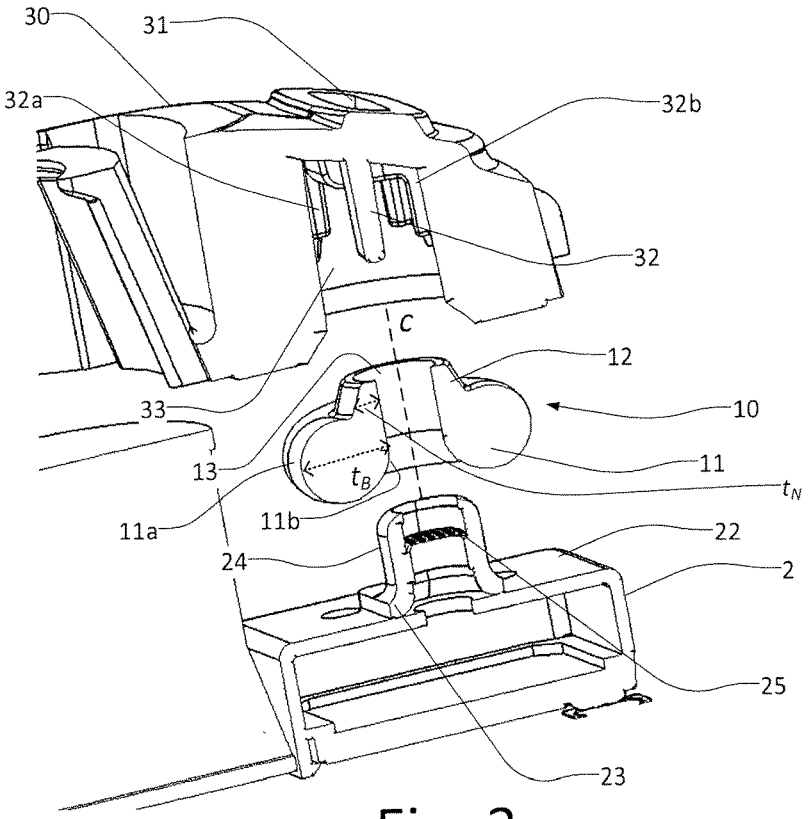
FIG. 3 illustrates an exploded cross sectional view of a part of a hearing aid having a barrier element according to FIG. 2.
Figure 4:
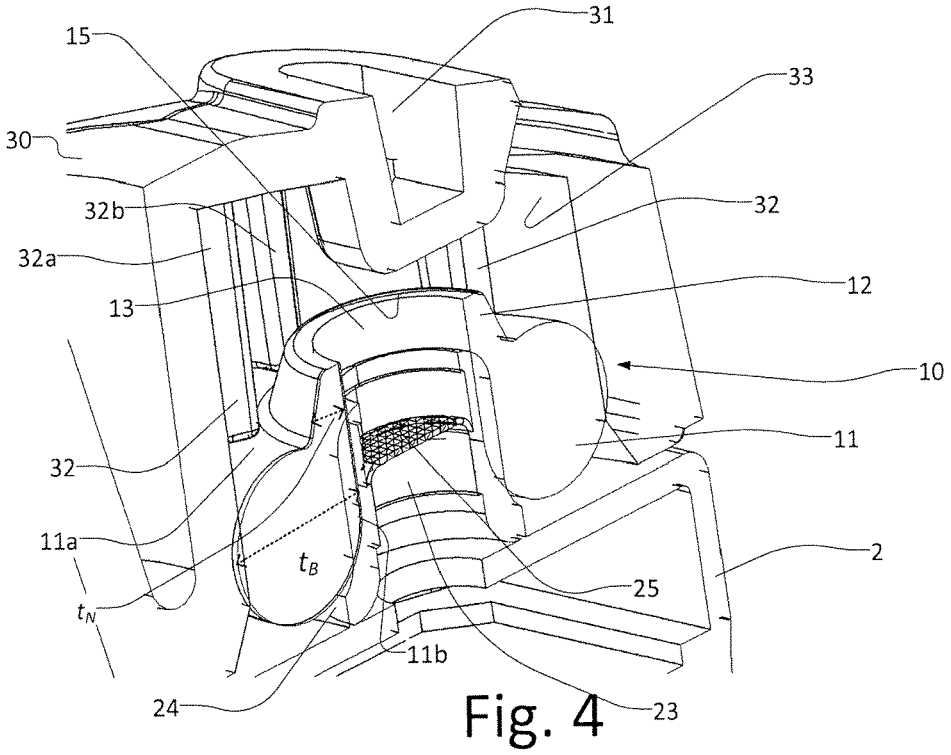
FIG. 4 illustrates a cross sectional side view according to FIG. 3.

Illustrated in FIG. 1 is a microphone unit 2 (i.e. the input unit), which comprises a sound port 23 having a dampening filter 25 (illustrated in FIGS. 3 and 4). The sound port 23 is in an assembled state of the hearing device exposed to an exterior and/or an interior environment of the hearing device. The microphone unit 2 comprises a bottom part 21 and a top part 22. At the top part 22 of the microphone unit 2, the sound port 23 protrudes at a distance away from the surface area of the top part 22. Additionally a barrier element 10, illustrated in FIG. 1, is in an assembled condition of the hearing device arranged on the sound port 23.

In more detail, the barrier element 10 comprises a base part 11 and a neck part 12, where the neck part 12 protrudes from the base part 11, and the base part 11 and neck part 12 together forms an inner channel 13 of the barrier element 10. As seen on FIGS. 1 and 2, the inner channel 13 of the barrier element 10 substantially surrounds a circumferential edge 24 of at least a part of the sound port 23 of the microphone unit 2. The inner channel 13 of the barrier element 10 thus provides for a sound path allowing sound to pass from an outside area of the microphone unit 2 through the inner channel 13 to the sound port 23. Furthermore, the neck part 12 of the barrier element 10 is substantially angled in relation to a longitudinal centerline c of the inner channel as is apparent from especially FIG. 3.

Figure 2:
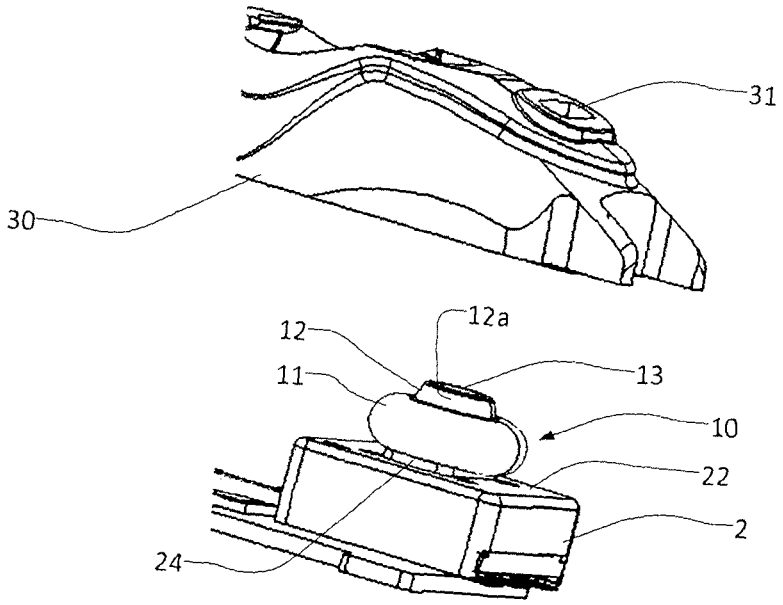
FIG. 2 illustrates an exploded side view of a hearing device having cover element and a barrier element attached to a microphone according to an embodiment of the disclosure.

Now referring to FIG. 2 illustrating an embodiment of the disclosure in more detail. Here the barrier element 10 is shown in a condition where it is connected to a microphone 2 of a hearing device. As is apparent from the figure, the barrier element 10 is arranged on the microphone unit 2 such that the sound port 23 of the microphone unit 2 extends into the inner channel 13 of the barrier element 10. With this configuration, at least the base part 11 of the barrier element 10 surrounds the circumferential edge 24 of the sound port 23. The barrier element 10 substantially abuts the surface area of the top part 22 of the microphone unit 2. The abutment of the barrier element to the surface area of the top part 22 of the microphone is in an embodiment configured such that an overlap between the microphone and the barrier element is approximately 0.18 mm. That is, the barrier element may cover 0.18 mm of the surface area of the microphone, taken as a measure from the circumferential edge 24 to an outer side of the barrier element 10

FIG. 2 also illustrates a cover element 30 according to an embodiment of the disclosure. When sound enters the hearing device, through sound inlets in for example shell parts of the hearing device, the microphone 2 receives the sound signal. One shell part could as illustrated in the figures be a cover element 30, which comprises a sound opening 31. The sound signal is substantially guided through the sound opening 31 in the cover element 30 into the internal environment of the hearing device. Here the sound port 23 of the microphone unit 2 receives the sound signal. In order to prevent unwanted sound to influence a clear sound signal, the barrier element 10 is arranged to abut the top surface area 22 of the microphone 2, thereby sealing the microphone unit 2 from the surroundings.

Accordingly, the neck part 12 protrudes from the base part 11 to substantially shelter the sound port 23 from the surrounding environment. Thus, in addition to the sealing effect of the barrier element 10, the configuration of an angled neck part 12 of the barrier element 10 provides for a protection system protecting against dirt, moist, earwax or other damaging environmental substances that might migrate on the surfaces of a hearing device and potentially cause damage to the microphones. The angled neck part 12 causes the damaging environmental substances coming in contact with the barrier element to migrate along the angled sides 12*a* of the neck part and are thereby be guided away from the sound inlet port 23 of the microphone unit 2.

In more detail, the sealing effect of the barrier element 10 is further improved when the barrier element 10 is connected to the microphone unit 2 in a manner illustrated in more detail in FIGS. 3 to 4. Here the cover element 30 comprises a sound opening 31 that is in acoustic communication with the sound port 23 of the microphone unit 2. The cover element 30 comprises a set of fastening elements 32 includes a set of flanges 32*a*, 32*b*, each protruding from the internal surface 33 of the cover element 30. The fastening elements 32 is provided as a set of protruding flanges 32, 32*a*, 32*b* that protrudes from the internal surface 33 of the cover element in a uniformly distributed manner. The set of flanges 32, 32*a*, 32*b*, extends along the internal surfaces 33 of the cover element 30. The fastening elements 32 are configured to retain the barrier element 10 in the position of substantially surrounding the circumferential edge 24 of at least a part of the sound port 23 of the microphone unit 2. With the configuration of the fastening elements 32 as illustrated in FIGS. 3 to 4, the protruding flanges 32, 32*a*, 32*b* essentially creates a grip with the barrier element 10 in an assembled condition. This grip forces the barrier element to stay in place on top of the inlet port 23 of the microphone unit 2.

In more detail, and best illustrated in FIG. 4, a top surface 11*a* of the base part 11 of the barrier element 10 connects with the protruding flanges 32, 32*a*, 32*b*, such that a compression force is applied to the top surface 11*a* of the base part 11 of the barrier element 10. Thus, the barrier element 10 is tightly connected with the microphone unit 2, whereby a reliable acoustical sealing is achieved.

In addition and with reference to especially FIGS. 3 and 4, the cover element 30, is configured such that the sound opening 31 of the cover element 30 is positioned substantially aligned with the sound port 23 of the microphone unit, thus creating a direct sound path between the sound opening in the cover element and the sound inlet unit. The sound is in this way less prone to fluctuate in the surrounding structure, but is instead guided more directly to the receiving source, such as the microphone unit 2 within a hearing device.

As is seen from FIGS. 3 and 4, the sound opening 31 is arranged substantially at the top of the neck part 12 opening 15 of the barrier element 10. However, in another implementation the sound opening 31 of the cover element 30 is slightly misaligned with the sound port 23 of the microphone 2. Such a slight misalignment provides for a protection against a direct path for damaging substances to fall into the inner channel 13 of the barrier element 10, which would potentially obstruct the microphone sound port 23. Thus, a centerline of the sound opening 31 would be slightly misaligned with the longitudinal centerline c of the inner channel 13.

Figure 8:
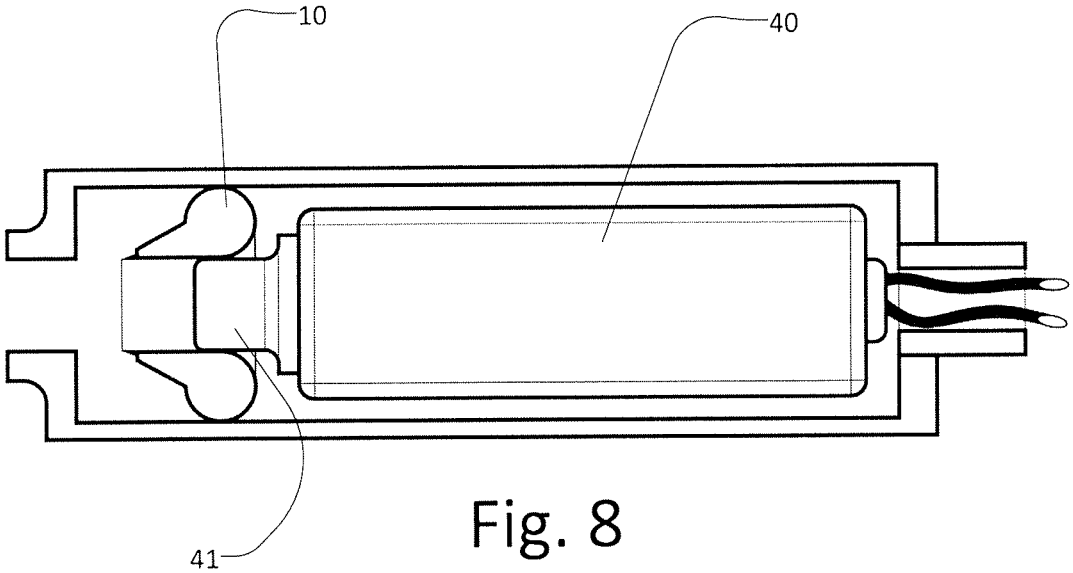
FIG. 8 illustrates a cross sectional side view of the hearing device having a barrier element connected to a speaker unit according to an embodiment of the disclosure.

A further embodiment and use of the barrier element according to the present disclosure is illustrated in FIG. 8. Here the barrier element 10 is used in connection with a speaker unit 40 of a hearing device. The barrier element 10 is connected with an output port 41 of the speaker unit 40. The speaker unit 40 is with the application of the barrier element 10 in a same manner as previously described protected against damaging substances which migrate along the internal surfaces of a hearing aid, especially against earwax and moist which build up in the ear canal of the outer ear during use of the hearing device. The fastening of the barrier element 10 may be provided in a similar manner as previously described by the use of fastening elements.

Figure 5:
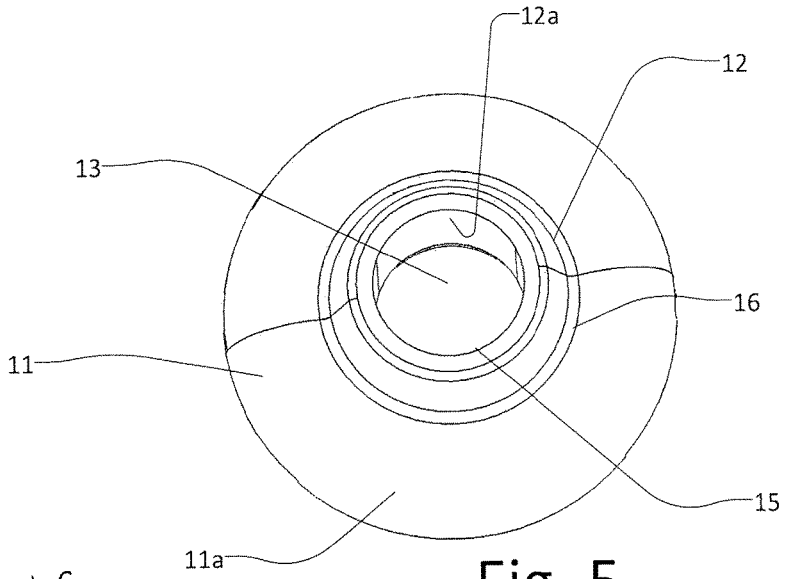
FIG. 5 illustrates a top view of the barrier element according to an embodiment of the disclosure.
Figure 6:
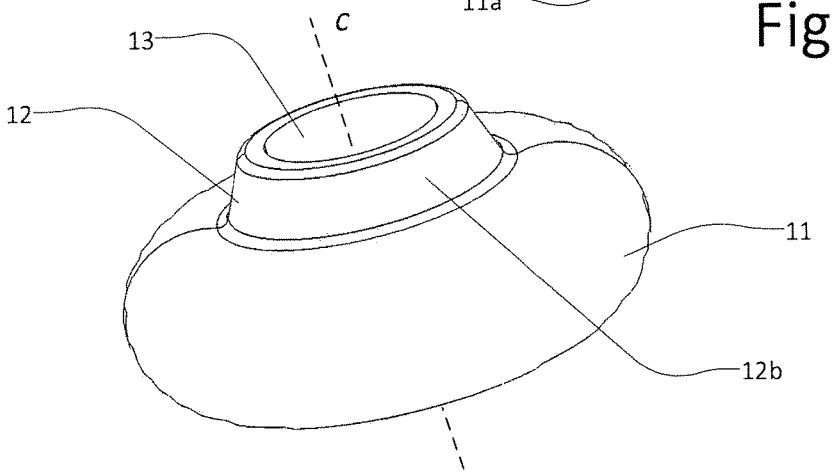
FIG. 6 illustrates a side perspective view of the barrier element according to an embodiment of the disclosure.
Figure 7:
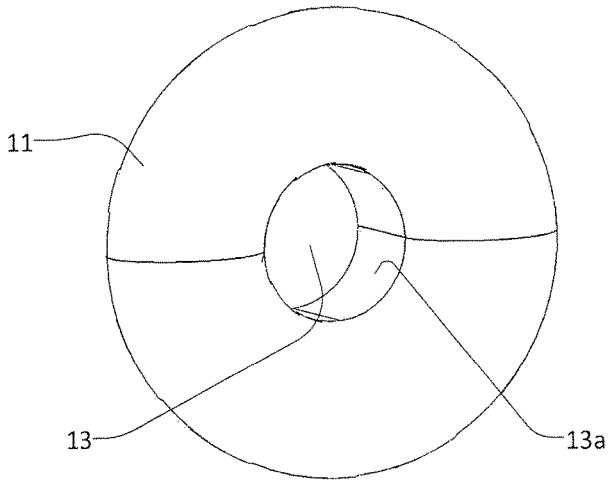
FIG. 7 illustrates a bottom view of the barrier element according to an embodiment of the disclosure.

Referring now to FIGS. 5 to 7, the structure, shape, function and effect of the barrier element 10 will be described in more detail. The figures illustrates a top view, perspective side view and bottom view, respectively, of the barrier element 10. In accordance with the previously described embodiments, the barrier element comprises a base part 11 and a neck part 12. The neck part 12 protrudes from the base part 11 at a transition point 16. As is apparent from the figures, the base part is in an embodiment substantially rounded in shape and comprises an outer surface 11*a*, which form a ring. An inner circumferential edge of the base part 11 defines an inner side 13*a* of the inner channel 13. In a similar manner, the neck part 12 is substantially rounded in shape and comprises an outer surface 12*b*, which form a ring shape. It is apparent that the ring shaping of the base part 11 is larger than the ring shaping of the neck part 12. Thus, the transition point is defined as the point 16 at the base part 11, where the ring of the neck part protrudes from the base part 11.

The base part 11 and neck part 12 together defines the inner channel 13 which in FIGS. 5 to 7 is substantially cylindrical and uniform. Thus, the longitudinal centerline c is defined by the radius of the cylinder for all points along the longitudinal direction of the inner side 13*a* of the inner channel 13. It should be noted that the shape of the barrier element does indeed not need to comprise a cylindrical shaped inner channel. It could also be rectangular in which case, the centerline would cross a point where two diagonal of the rectangle crosses.

The neck part 12 of the barrier element 10 is as can be seen from the figures angled in relation to the longitudinal centerline c of the inner channel 13. The neck part 12 comprises an inner edge 12*a* corresponding to the inner side 13*a* of the inner channel and an outer edge 12*b* (i.e. the outer sides of the neck part). The distance between the inner edge 12*a* and the outer edge 12*b* defines a thickness $t_N$ (see FIG. 4) of the material of the neck part 12. As is apparent from the figures, and especially FIGS. 3 and 4, the thickness of the material of the neck part 12 decreases as a function of distance from the transition point 16 to the opening 15 of the neck part 12. Thus, the angled characteristics of the neck part 12 is substantially defined by the decreasing thickness of the material of the neck part 12. For achieving an efficient protection system, the opening of the neck part comprises a substantially rounded shape having a thickness of less than 0.1 mm, a thickness of 0.075 mm or a thickness of 0.13 mm.

Accordingly, the base part 11 also comprises an inner edge 11*b* defined substantially by the inner side 13*a* of the inner channel 13, and an outer edge 11*a* defined as the outer surface of the base part 11. The thickness $t_B$ (see FIG. 3 or 4) of the material of the base part 11 is thus the distance between the inner edge 11 and the outer edge.

Figure 9A:
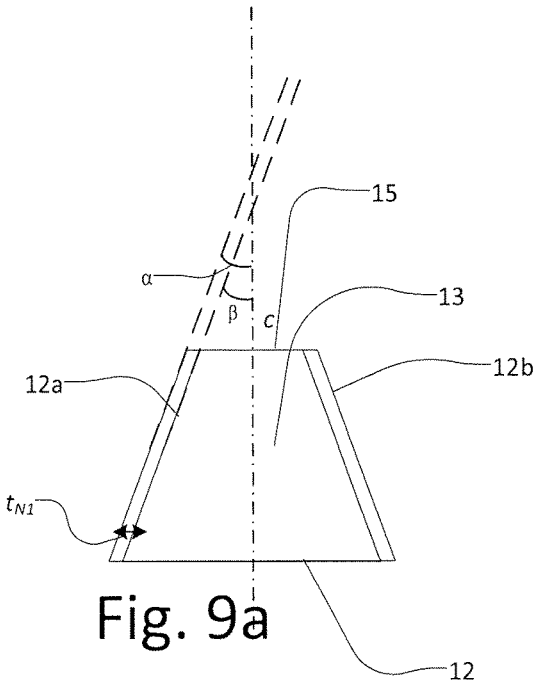
FIGS. 9*a* to 9*c* is schematic illustration of the angle of the neck part according to embodiments of the disclosure.
Figure 9B:
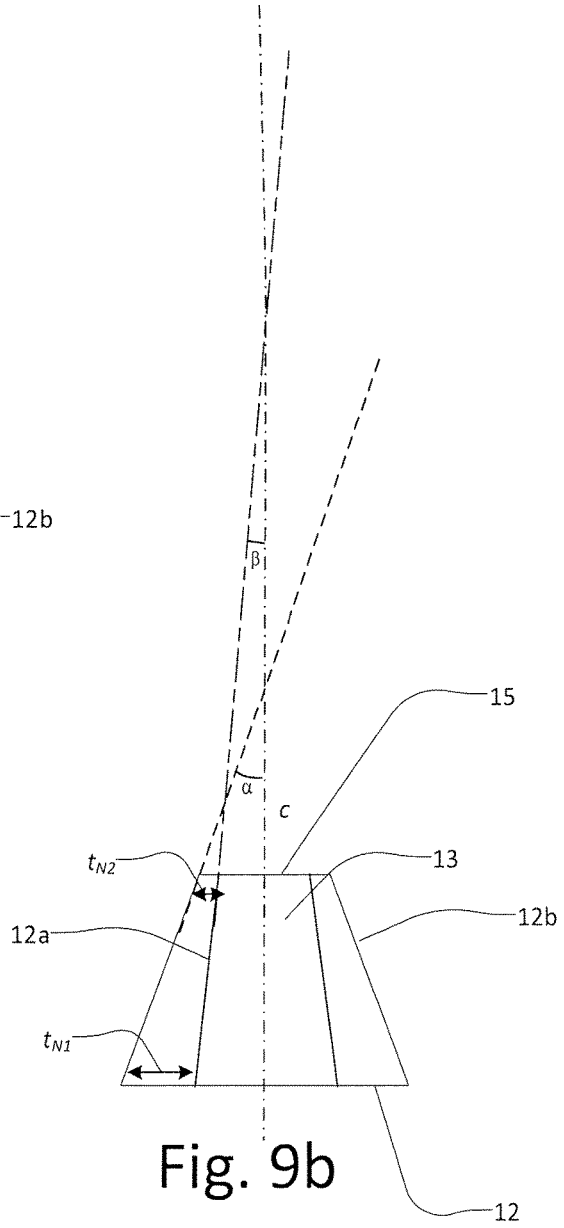
Figure 9C:
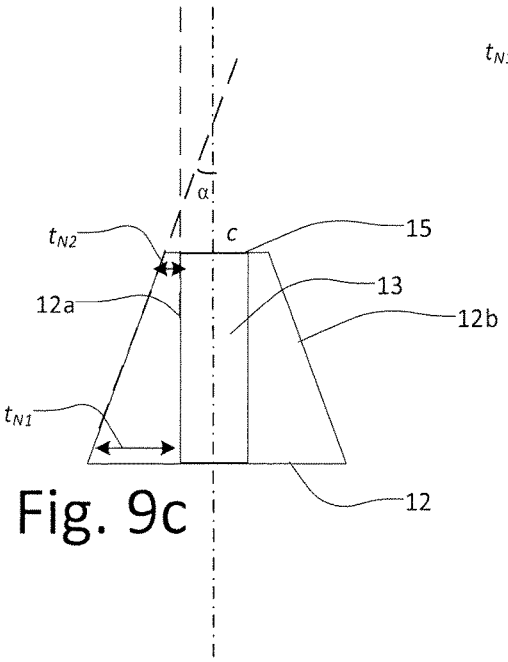

Referring now to FIGS. 9*a* to 9*c*, the neck part 12 is schematically illustrated. As is apparent and previously explained, the neck part 12 is shaped such that at least the outer sides 12*b* (i.e. the outer edges) of the neck part 12, i.e. the sides facing the interior environment, define an angle, a, with the centerline c of the inner channel. The angle, a, should be construed to be the smaller angle, a, which the centerline and an imaginary line drawn from the outer side of the neck part forms with the centerline.

Within an embodiment of the disclosure, it should be construed that the inner sides 12*a* (i.e. the inner edge) of the neck, part (i.e. the sides of the neck part substantially constituting the sides of the inner channel) could also be angled in relation to the centerline c of the inner channel 13. As previously mentioned the angle may also here be construed as the smaller angle, β, formed by drawing a line along the inner side of the neck part to the longitudinal centerline.

Accordingly, in an embodiment of the disclosure, the neck part may define two angles, a first angle, α, and a second angle, β, with the centerline. In an embodiment of the disclosure the angle $\alpha \geq \beta$, with respect to the longitudinal centerline of the inner channel.

Thus, in an embodiment, illustrated in FIG. 9*a*, the angles α and β are equal. In the embodiments illustrated in FIGS. 9*b* and 9*c*, the angles are such that $\alpha \geq \beta$, whereas in FIG. 9*c*, angles are such that $\beta = 0$ (i.e. parallel with the centerline c of the longitudinal channel 13).

Additionally and schematically illustrated in FIGS. 9*a* to 9*c*, the neck part at the transition point 16 between the base part and the neck part comprises a first thickness, $t_{n1}$ and at the opening 15 to the inner channel comprises a second thickness $t_{n2}$.

In the embodiments of FIGS. 9*b* and 9*c*, the thickness $t_{n2}$ is smaller than the thickness $t_{n1}$, which provides a smaller surface area at the opening 15 into the inner channel 13 of the neck part 12. The thickness may be any preferred value, and could be 0.1 mm or less, such as 0.075 or in an embodiment the thickness could be 0.2 mm or less, such as 0.13 mm. As is seen in FIGS. 9*b* and 9*c*, such configurations thus provides for a substantially cone-shaped inner channel or uniform channel, respectively.

In the embodiment of FIG. 9*a*, the thickness $t_{n2}$ is equal to the thickness $t_{n1}$, where the thickness $t_{n2}$ may be the same values as previously described. Other configurations than one shown in the embodiments of FIGS. 9*a* to 9*c* would be construed by a skilled person to fall within the scope of the disclosure.

With reference to the embodiments shown in FIGS. 10 and 11, the hearing inlet device system according to the disclosure will be explained in more detail.

As is apparent from the Figures, the cover element 30 (i.e. the top shell) forms part of a hearing device inlet system providing a mechanical and acoustical interface between and exterior and interior environment of the hearing device.

Such hearing device inlet system comprise a top shell 30 (i.e. the cover element) and a bottom shell 70 (i.e. a chassis) which in an assembled condition forms part of a hearing device (not all parts shown), and wherein at least an input unit 2 (according to the present disclosure) is arranged on the bottom shell 70, and where the top shell 30 is configured to cover the input unit 2.

In the specific embodiment shown, the top shell 30 corresponds to the cover element and is configured with the features corresponding to the previously described cover element. That is, the cover element 30 may be provided with fastening elements 32, such as flanges or ribs extending along an inner side 33 of the cover element 30. This, to support a barrier element 10 according to the present disclosure and as previously described. The barrier element 10 may thus be provided according to the embodiments described previously in this disclosure.

The cover element 30 further comprises at least one sound opening 31, which is substantially aligned with a sound port (not shown in detail) on the input unit 2 providing a direct sound path between the sound opening and the sound port. In the embodiment illustrated in FIGS. 10 and 11, the cover element 30 comprises at least two sound openings 31, 36, which sound openings are provided to create a direct sound path between two input unit, i.e. the two microphones 2, 2*a* illustrated in FIGS. 10 and 11.

As illustrated in the Figures, the hearing device inlet system in an assembled condition, is configured such that the flanges 32 of the cover element 30 substantially abuts sides of the barrier elements 10 (as previously described). This creates an inlet cavity 90 between the sound opening 31, 36 in the cover element 30 and the barrier element 10. Such inlet cavity 90 creates a volume in front of the inlet unit 2 (i.e. the microphone), which can be trimmed to match an acoustical volume of the second inlet units cavity. This provides an improved acoustical behavior of the hearing device inlet system.

In addition, the volumes of the inlet cavities 90 may in this way be designed to minimize the impact from high frequency noise. In other words, the inlet cavities 90 provides an acoustical volume which is critical for the final acoustical performance of the hearing device. In the embodiment shown, the volumes 90 is designed, and matched such that the acoustical response from a first inlet unit 2 (e.g. a microphone) and a second inlet unit 2*a* (e.g. a second microphone) is identical.

Furthermore, the top shell (i.e. the cover element 30) comprises a set of attachment elements 35, such as hooks, which in an assembled condition is configured to connect with the bottom shell 70 (i.e. a chassis) so that the cover element 30 is fixed to and kept in place on the chassis 70. Thus, the top shell 30 and bottom shell 70 are configured to create a detachable click-locking configuration, such that the cover element may be attached and detached as needed. Together, the top shell 30 and bottom shell 70 defines a substantially closed environment having in the specific embodiment two barrier elements arranged onto two different microphones. Accordingly, the bottom shell 70 (i.e. the chassis) comprises a set of receiving parts 71 which are configured to receive the attachment elements 35 of the cover element 30.

Figure 10:
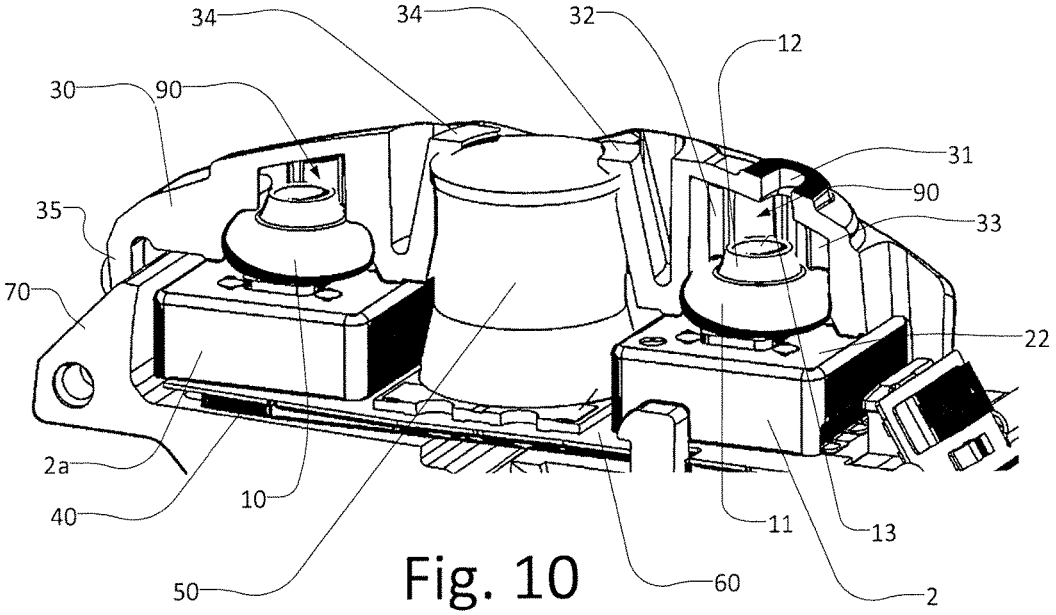
FIG. 10 is a cross sectional view of a hearing inlet system according to an embodiment of the disclosure.
Figure 11:
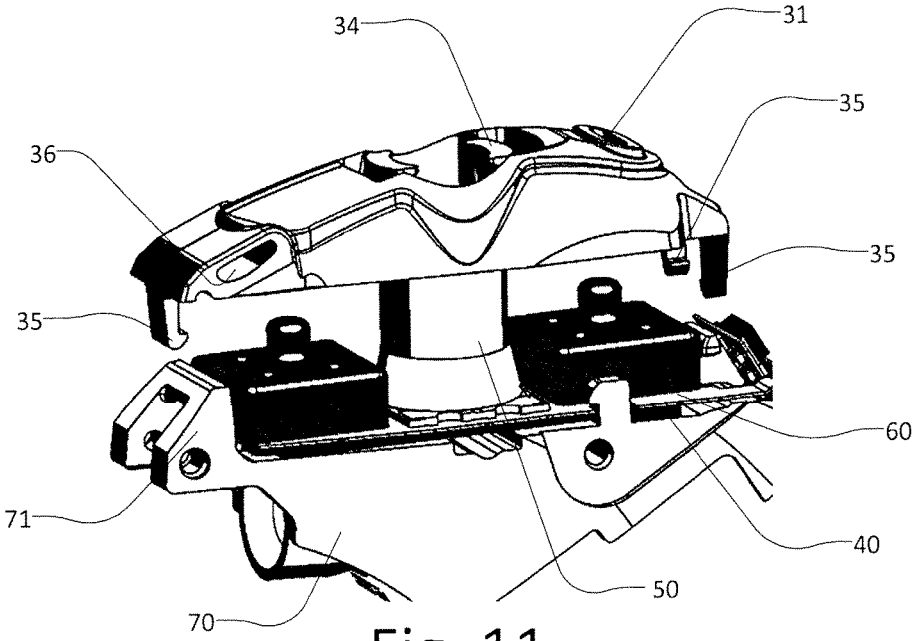
FIG. 11 is a partly exploded side view of a hearing inlet system according to an embodiment of the disclosure.

According to the FIGS. 10 and 11, a pad element 40, such as a foam pad is arranged on the chassis 70. The pad element 40 provides the required sealing force between the top shell 30 and the bottom shell 70 of the hearing device inlet system.

In a normal use of a hearing device according to the disclosure as a whole, vibrations from the receiver (i.e. the output unit) usually located in connection with the chassis (not shown) makes at least a part of the chassis vibrate. The chassis supports a printed circuitry board (PCB) 60, further supporting the microphones 2, 2*a*. Thus, vibrations of the receiver causes acoustic feedback in a hearing device amplifier of the PCB. By arranging a foam pad 40 (i.e. the pad element) on the chassis 70 and below the PCB 60, acoustic feedback caused by vibrations of the receiver are minimized.

Thus, the pad element 40, may absorb and/or decouple the vibrations caused by for example the output unit (e.g. an receiver) before it reaches the input units (i.e. the microphones).

Furthermore, in an embodiment (not shown) the pad element comprises an adhesive back-liner providing an adhesive surface enabling the pad element to stick to the bottom shell and support the input units.

The hearing device system also comprises a tele coil 50 positioned in connection with the PCB 60 and the microphones 2, 2*a*. The tele coil are fixated within the top shell 30 and bottom shell 70 through flexible arms 34 of the cover element 30. Such fixation, where the flexible arms 34 creates a grip at a top of the tele coil 50 provides a proper fixation, such that the tele coil 50 does not easily detach from the PCB 60. The flexible arms 34 are able to absorb potential forces influencing the hearing device during use, such that the tele coil 50 stays in place.

The hearing device inlet system according to the disclosure is configured such that the assembled parts may be programmed and tested prior to the final assembly with other parts of a hearing device providing a final hearing aid, such as with outer shells of the hearing aid. That is, the hearing device inlet system may, with the configuration of the different parts as described in the different embodiments according to the disclosure, be pre-assembled, at least for programming and testing by

- providing a cover element 30 having the features according to the disclosure,
- providing a chassis 70 having the features according to the disclosure,
- providing at least one inlet unit 2, 2*a*,
- providing a pad element 40, and
- attaching the pad element 40 to the chassis 70, and attaching the input units 2, 2*a* to the pad element 40 (e.g. through a printed circuitry board 60), and finally attaching the cover element 30 to the chassis 70 by connecting the attachment elements 35 of the cover element 30 to the receiving elements 71 of the chassis 70.

With this assembly, the hearing device inlet system may be programmed and tested without losing the inlets parts (e.g. the cover and input units) thereof. The hearing device inlet system, is with this configuration designed as a platform where the different acoustic tests may be performed prior to a final assembly of the hearing aid. Thus, the hearing device inlet system, is used as a pre-testing platform, which may be used in different kinds of hearing device exterior shells. The exterior shell of the hearing device should be understood as an outermost shell part of the hearing device, which are visible to a user.

In addition to the described embodiments, it should be contemplated that the hearing device according to the disclosure may also be used within a hearing system. A "hearing system" refers to a system comprising one or two hearing devices. Further to a hearing system, a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a Smartphone or other electronic device, the Smartphone/electronic device possibly running an application that controls functionality of the at least one hearing device.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items.

It should be appreciated that reference throughout this specification to "an embodiment" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various embodiments described herein. Various modifications to these embodiments will be readily apparent to those skilled in the art, and the generic principles defined herein may be applied to other embodiments.

The claims are not intended to be limited to the embodiments shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing device comprising an input unit for receiving an acoustic signal from a user's surroundings and providing a corresponding audio signal, and an output unit receiving said audio signal and providing an audible signal to the user, where the input and/or output unit(s) comprises a sound port which are exposed to the exterior and/or an interior environment of the hearing device, the hearing device further comprising a barrier element having a base part and a neck part, said neck part protruding from said base part, and said base part and neck part forming an inner channel of said barrier element such that interior sides of said neck part define a portion of said inner channel, wherein said inner channel of the barrier element is arranged to substantially surround a circumferential edge of at least a part said sound port while allowing for sound to pass through said inner channel to said sound port, wherein the interior sides of said neck part protrude from said base part at a substantially constant first angle of zero or more degrees in relation to a longitudinal centerline of said inner channel, wherein exterior sides of said neck part protrude from said base part at a substantially constant second angle greater than zero degrees in relation to the longitudinal centerline of said inner channel, said second angle being greater than said first angle, wherein said base part is comprised of a ring surrounding a portion of the sound port, and wherein around said portion of the sound port, the thickness of said ring defines interior and exterior sides of said base part.

2. A hearing device according to claim 1, wherein the exterior sides of the neck part are configured to simultaneously guide foreign substances to said base part and away from said longitudinal centerline.

3. A hearing device according to claim 1, wherein the sound port of said input and/or output unit(s) extends into the inner channel of said barrier element, such that at least the base part of said barrier element surrounds the circumferential edge of the sound port with or without sheltering the sound port.

4. A hearing device according to claim 1, wherein the exterior sides of said neck part define an angle with the longitudinal centerline of the inner channel within the range of 30 to 60 degrees.

5. A hearing device according to claim 1, where said base part comprises a shape that substantially covers a surface area around the sound port of the input and/or output unit.

6. A hearing device according to claim 1, wherein said neck and said base part is substantially circular and said base part forms the ring around the sound port of at least one of said input and/or output unit(s) as viewed from a sightline parallel to said longitudinal center.

7. A hearing device according to claim 1, wherein the inner channel of said barrier element is uniform relative to the longitudinal centerline of said inner channel.

8. A hearing device according to claim 1, wherein said neck part defines an opening at a distance from said sound port and where a transition point is defined between said base part and said neck part, said transition point being substantially closer to the sound port than said opening of said neck part.

9. A hearing device according to claim 1, wherein said neck part at a transition point between said base part and said neck part comprises a first thickness, and at an opening of said inner channel comprises a second thickness, which thickness decreases in size as a function of distance from said transition point to said inner channel opening of said neck part, or at least that said second thickness is smaller than said first thickness.

10. A hearing device according to claim 9, wherein said opening of said neck part comprises a substantially rounded shape having a thickness within the range of less than 0.05 mm to 0.2 mm, the thickness being defined as a point on the inner side wall of the inner channel to a point on the outer side of the surface of the neck part.

11. A hearing device according to claim 1, wherein said barrier element is retained by fastening means of said sound port.

12. A hearing device according to claim 1, wherein said hearing device further comprises a cover element having a sound opening which are in acoustic communication with said sound port of said input and/or output unit, and comprises a set of fastening elements, said fastening elements being configured to retain said barrier element at the position substantially surrounding a circumferential edge of at least a part said sound port.

13. A hearing device according to claim 12, wherein an outer surface of the barrier element abuts a set of fastening elements, said fastening elements including protruding flanges provided on said inner sides of the cover element.

14. A hearing device according to claim 12, wherein the sound opening of the cover element is configured to be positioned substantially aligned with the sound port of the input unit, such that a direct sound path between the sound opening in the cover element and the sound port of the input and/or output unit is provided along said inner channel.

15. A barrier element for use in a hearing device, said barrier element comprising a base part; and a neck part, wherein said neck part at a transition point protrudes from said base part, wherein said base part and said neck part defines an inner channel of said barrier element such that interior sides of said neck part define a portion of said inner channel, wherein the interior sides of said neck part protrude from said base part at a substantially constant first angle of zero or more degrees in relation to a longitudinal centerline of said inner channel, wherein exterior sides of said neck part protrude from said base part at a substantially constant second angle greater than zero degrees in relation to the longitudinal centerline of said inner channel, said second angle being greater than said first angle, wherein the input and/or output unit(s) comprises a sound port exposed to the exterior and/or an interior environment of the hearing device, said inner channel of the barrier element being arranged to substantially surround a circumferential edge of at least a part said sound port while allowing for sound to pass through said inner channel to said sound port, wherein said base part is comprised of a ring surrounding a portion of the sound port, and wherein around said portion of the sound port, the thickness of said ring defines interior and exterior sides of said base part.

16. A hearing device according to claim 15, wherein the exterior sides of said neck part are configured to simultaneously guide foreign substances to said base part and away from said longitudinal centerline.

17. A barrier element according to claim 15, wherein the neck part comprises an inner edge corresponding to the inner sides of the inner channel and an outer edge, where the distance between the inner edge and the outer edge defines a thickness t of the material of the neck part, wherein said neck part at said transition point comprises a first thickness, and at an opening of said neck channel comprises a second thickness, which thickness decreases in size as a function of distance from said transition point to said opening of said neck part, or at least that said second thickness is smaller than said first thickness.

18. A hearing device according to claim 1, wherein the second angle is less than 90 degrees.

19. A hearing device according to claim 1, wherein said base part has a bottom surface abutting said input and/or output unit(s), said base part having a top surface configured to receive a compression force retaining said barrier element in abutment with said input and/or output unit(s).

20. A hearing device comprising an input unit for receiving an acoustic signal from a user's surroundings and providing a corresponding audio signal, and an output unit receiving said audio signal and providing an audible signal to the user, where the input and/or output unit(s) comprises a sound port which are exposed to the exterior and/or an interior environment of the hearing device, the hearing device further comprising a barrier element having a base part forming an inner channel of said barrier element, said base part having a bottom surface abutting said input and/or output unit(s), said base part having a top surface configured to receive a compression force retaining said barrier element in abutment with said input and/or output unit(s), wherein said inner channel of the barrier element is arranged to substantially surround a circumferential edge of at least a part said sound port while allowing for sound to pass through said inner channel to said sound port.

21. A hearing device according to claim 20, wherein said base part is comprised of a ring surrounding a portion of the sound port, and wherein around said portion of the sound port, the thickness of said ring defines interior and exterior sides of said base part.

* * * * *